US010315089B2

(12) United States Patent
Liao

(10) Patent No.: US 10,315,089 B2
(45) Date of Patent: Jun. 11, 2019

(54) BASKETBALL SHOOTING TRAINING DEVICE

(71) Applicant: Chien-Yi Liao, Pingtung County (TW)

(72) Inventor: Chien-Yi Liao, Pingtung County (TW)

( * ) Notice: Subject to any disclaimer, the term of this patent is extended or adjusted under 35 U.S.C. 154(b) by 18 days.

(21) Appl. No.: 14/949,852

(22) Filed: Nov. 23, 2015

(65) Prior Publication Data

US 2017/0144045 A1 May 25, 2017

(51) Int. Cl.
*A63B 69/00* (2006.01)

(52) U.S. Cl.
CPC ..... *A63B 69/0071* (2013.01); *A63B 69/0057* (2013.01); *A63B 69/0059* (2013.01); *A63B 69/0091* (2013.01); *A63B 2208/0204* (2013.01); *A63B 2225/09* (2013.01); *A63B 2225/10* (2013.01)

(58) Field of Classification Search
CPC ..... A63B 69/0091; A63B 69/0071; A63B 2208/0204
See application file for complete search history.

(56) References Cited

U.S. PATENT DOCUMENTS 1,530,519 A * 3/1925 Remington ..... A63B 69/0059 434/252
3,550,937 A * 12/1970 Patterson ..... A63B 69/0071 473/139
4,383,685 A * 5/1983 Bishop ..... A63B 69/0071 473/450
4,565,527 A * 1/1986 Burchett ..... A63B 69/0071 273/371
4,579,341 A * 4/1986 Furr ..... A63B 69/0071 473/450
4,717,149 A * 1/1988 Juhl ..... A63B 69/0071 473/429
5,324,026 A * 6/1994 Conlon ..... A63B 69/0071 473/450
5,599,016 A * 2/1997 Larkin ..... A63B 69/0071 473/448
5,688,212 A * 11/1997 Walker ..... A63B 69/0057 473/215
6,213,899 B1 * 4/2001 Maske ..... A63B 69/0071 473/409
6,595,865 B2 * 7/2003 Stitz ..... A63B 69/0057 473/257
6,612,845 B1 * 9/2003 Macri ..... A63B 21/0552 434/247

(Continued)

*Primary Examiner* — Melba Bumgarner
*Assistant Examiner* — Amir A Klayman
(74) *Attorney, Agent, or Firm* — Winston Hsu

(57) ABSTRACT

A basketball shooting training device includes a main frame, a first vertical rail structure having vertical and oblique rail portions, a first sliding base, and a first basketball imitation member. The first vertical rail structure is disposed on the main frame. The first sliding base is slidably disposed on the first vertical rail structure for sliding along the first vertical rail structure. The first basketball imitation member is connected to the first sliding base. When the first basketball imitation member is propped and then propelled upwardly by a user's hand, the first sliding base slides from a first initial position on the vertical rail portion to a shooting position on the oblique rail portion for guiding the user's hand to complete a set shot along the first vertical rail structure.

16 Claims, 8 Drawing Sheets

(56) References Cited

U.S. PATENT DOCUMENTS

| | | | | |
|---|---|---|---|---|
| 6,645,093 | B2 * | 11/2003 | Sheppard | A63B 69/0071 473/422 |
| 6,679,794 | B1 * | 1/2004 | Vitello | A63B 69/0071 473/433 |
| 7,056,224 | B1 * | 6/2006 | Keyes | A63B 21/154 473/229 |
| 7,226,373 | B2 * | 6/2007 | Arenas | A63B 69/0002 473/417 |
| 7,651,406 | B1 * | 1/2010 | Yeh | A63B 69/36 473/221 |
| 8,246,524 | B2 * | 8/2012 | Castillo | A63B 21/023 482/101 |
| 8,292,761 | B2 * | 10/2012 | Krawczyk | A63B 69/0002 473/430 |
| 9,227,130 | B1 * | 1/2016 | Burdick | A63B 69/385 |
| 9,308,427 | B2 * | 4/2016 | Garner | A63B 43/00 |
| 2011/0207101 | A1 * | 8/2011 | Garner | A63B 43/00 434/248 |
| 2015/0087448 | A1 * | 3/2015 | Huang | A63B 69/0071 473/447 |

* cited by examiner

BASKETBALL SHOOTING TRAINING DEVICE

BACKGROUND OF THE INVENTION

1. Field of the Invention

The present invention relates to a basketball shooting training device, and more specifically, to a basketball shooting training device for guiding a user's hand to complete a set shot along a vertical rail structure.

2. Description of the Prior Art

In general, proper shooting techniques could help a basketball player shoot a basketball into a basket successfully. One important technique is proper wrist motion. During the basketball player shoots the basketball, the basketball player needs to cock his wrist and then propel the basketball through the air into the basket. However, proper wrist motion is not enough if the basketball player could not properly position his lower arm at the same vertical plane with his upper arm while shooting the basketball. Thus, how to design a device to train a basketball player to develop both proper wrist motion and proper arm motion is one important issue in basketball shooting training.

SUMMARY OF THE INVENTION

The present invention discloses a basketball shooting training device. The basketball shooting training device includes a main frame, a first vertical rail structure, a first sliding base, and a first basketball imitation member. The main frame has a transverse frame portion and a standing frame portion for standing on a holding plane. The transverse frame portion is connected to the standing frame portion. The first vertical rail structure is disposed on the transverse frame portion. The first vertical rail structure has a vertical rail portion and an oblique rail portion connected to a top end of the vertical rail portion. The first sliding base has a first base portion and a first arm portion. The first base portion is slidably disposed on a first side of the first vertical rail structure for sliding along the first vertical rail structure. The first arm portion extends from the first base portion. The first basketball imitation member is connected to the first arm portion. When the first basketball imitation member is propped and then propelled upwardly by a user's hand, the first base portion slides from a first initial position on the vertical rail portion to a shooting position on the oblique rail portion for guiding the user's hand to complete a set shot along the first vertical rail structure.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
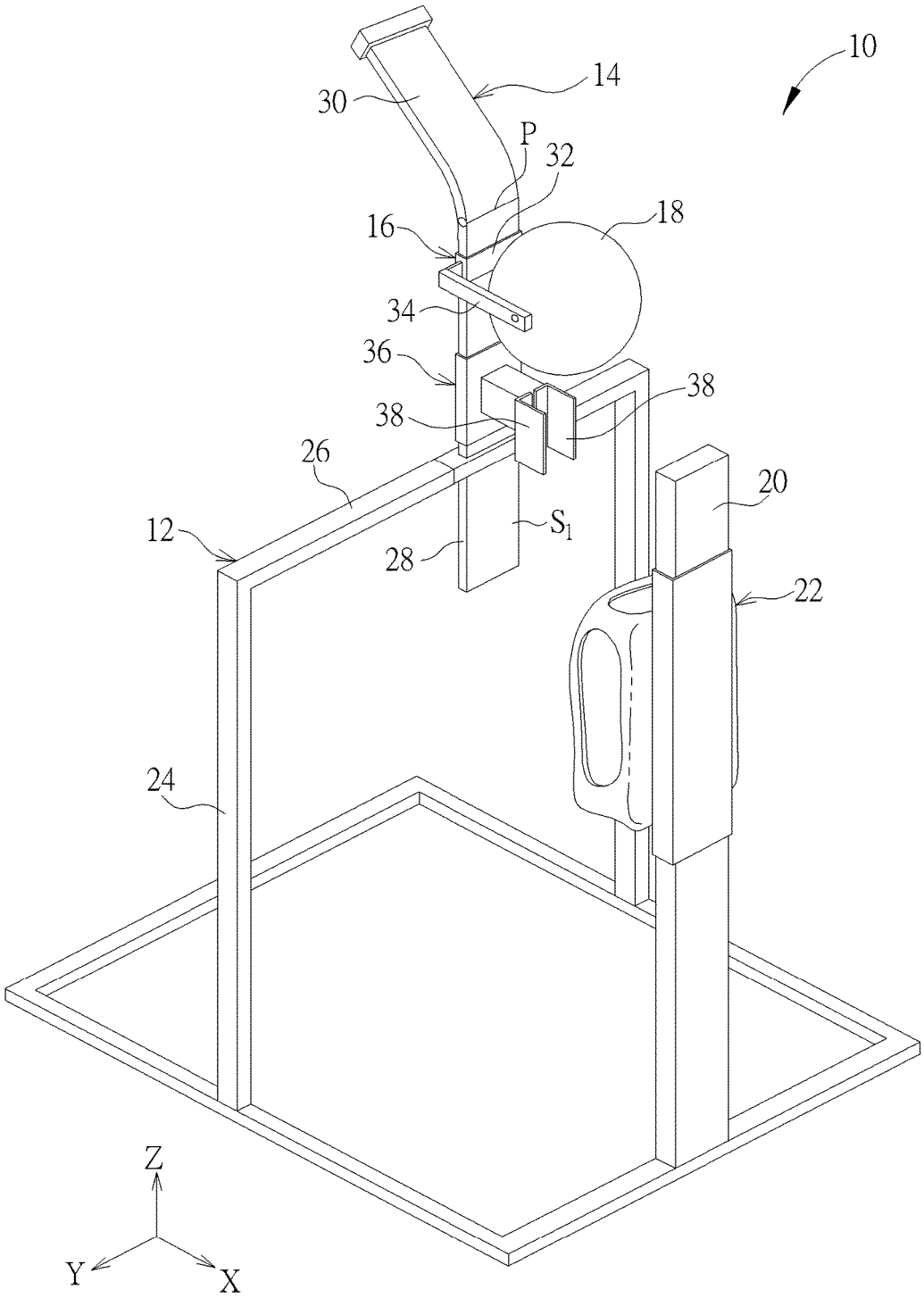
FIG. 1 is a diagram of a basketball shooting training device according to an embodiment of the present invention.

Please refer to FIG. 1, which is a diagram of a basketball shooting training device 10 according to an embodiment of the present invention. As shown in FIG. 1, the basketball shooting training device 10 includes a main frame 12, a first vertical rail structure 14, a first sliding base 16, a first basketball imitation member 18, a second vertical rail structure 20, and a torso attachment member 22. The main frame 12 has a standing frame portion 24 and a transverse frame portion 26. The transverse frame portion 26 is connected to the standing frame portion 24, and the standing frame portion 24 is used for standing on a holding plane (such as a ground plane) so that the basketball shooting training device 10 could be placed steadily on the holding plane for a user (e.g. a basketball player) to operate conveniently. The first vertical rail structure 14 is disposed on the transverse frame portion 26 and has a vertical rail portion 28 and an oblique rail portion 30 connected to a top end P of the vertical rail portion 28. In this embodiment, the oblique rail portion 30 is preferably pivoted to the top end P of the vertical rail portion 28 (e.g. by a hinge, but not limited thereto), so that the user could properly adjust his shooting angle by adjusting an oblique angle of the oblique rail portion 30 relative to the vertical rail portion 28.

The first sliding base 16 has a first base portion 32 and a first arm portion 34. The first base portion 32 is slidably disposed on a first side $S_1$ of the first vertical rail structure 14 for sliding along the first vertical rail structure 14. The first arm portion 34 extends from the first base portion 32. The first basketball imitation member 18 is connected to the first arm portion 34 so that the user could prop the first basketball imitation member 18 by his shooting hand for performing a shooting motion. In practical application, the weight of the first basketball imitation member 18 could be increased by adding fillers (e.g. water or sand) into the first basketball imitation member 18 for achieving the muscles training purpose.

Furthermore, the second vertical rail structure 20 is spaced apart from the main frame 12 and is connected to the standing frame portion 24. The torso attachment member 22 is slidably disposed on the second vertical rail structure 20 for attaching to the user's torso so as to guide the user's torso to move vertically along the second vertical rail structure 20, so as to improve the postural stability of the user during the user performs a shooting motion. In this embodiment, the torso attachment member 22 could be a wearable equipment (e.g. a wearable vest), but not limited thereto. That is, in another embodiment, the present invention could adopt other attachment equipment (e.g. a lap-shoulder harness) which could be attached to the user's torso. To be noted, the second vertical rail structure 20 and the torso attachment member 22 could be omissible components for simplifying the mechanical design of the basketball shooting training device 10.

Furthermore, for ensuring that the user could properly position his lower arm at the same vertical plane with his upper arm while propping and then propelling the first basketball imitation member 18 upwardly by his shooting hand, as shown in FIG. 1, the basketball shooting training device 10 could further include an arm guide base 36. The arm guide base 36 is disposed on the first side $S_1$ of the first vertical rail structure 14 and located under the first sliding base 16. The arm guide base 36 has two guide sheets 38 spaced apart thereon for constraining the user's lower arm put therebetween at the same vertical plane with the user's upper arm. In practical application, the two guide sheets 38 could be movably disposed on the arm guide base 36 and the first vertical rail structure 14 could be movable leftward and rightward and pivotable forward and rearward relative to the transverse frame portion 26, so that the user could conveniently adjust positions of the two guide sheets 38 relative to the user for aligning the user's lower arm with the user's upper arm at the same vertical plane. As for the related description for the mechanical designs for making the two guide sheets 38 movably disposed on the arm guide base 36 and making the first vertical rail structure 14 disposed on the transverse frame portion 26 movably and pivotably, it is commonly seen in the prior art and omitted herein. Moreover, in another embodiment, the vertical rail portion 28 could be an arc-shaped rail instead of a linear rail as shown in FIG. 1, for helping the user complete a set shot along the first vertical rail structure 14 more smoothly.

Figure 2:
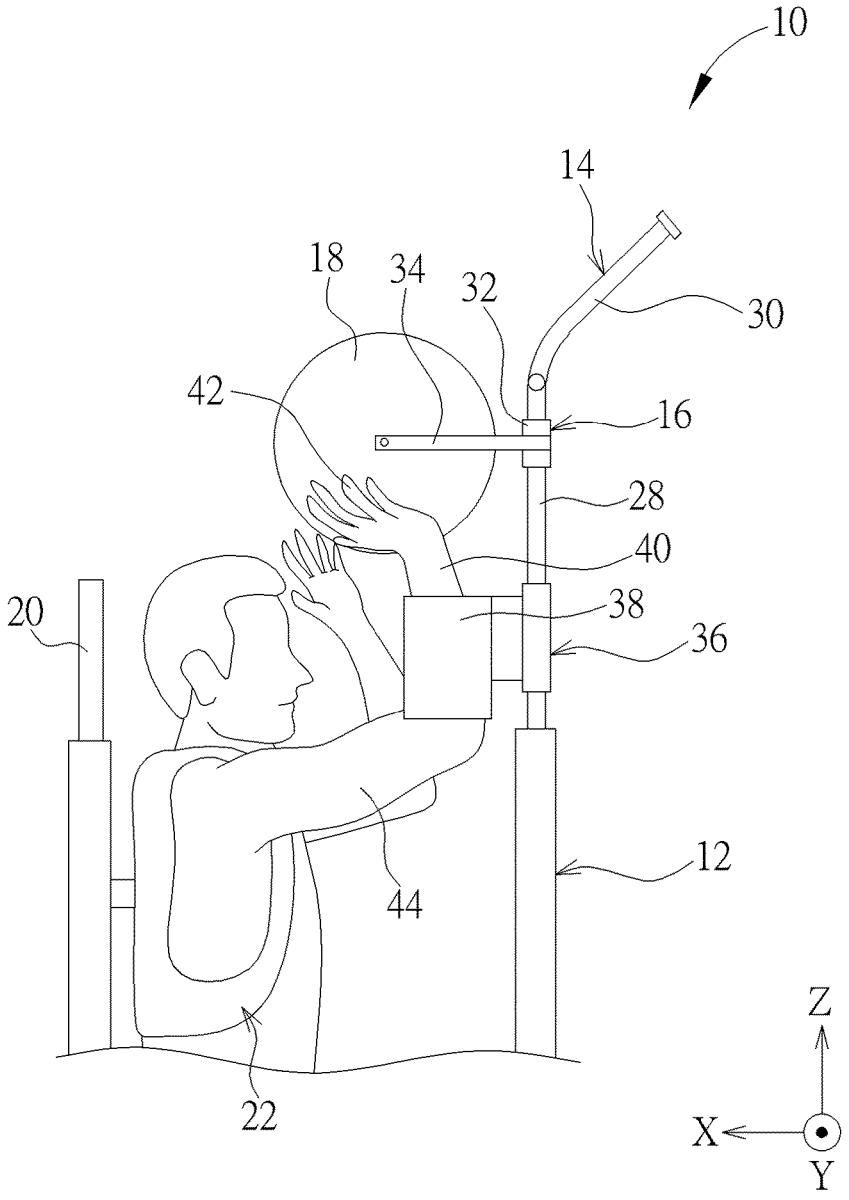
FIG. 2 is a side view of a user wearing a torso attachment member and propping a first basketball imitation member at a knee bending position.
Figure 3:
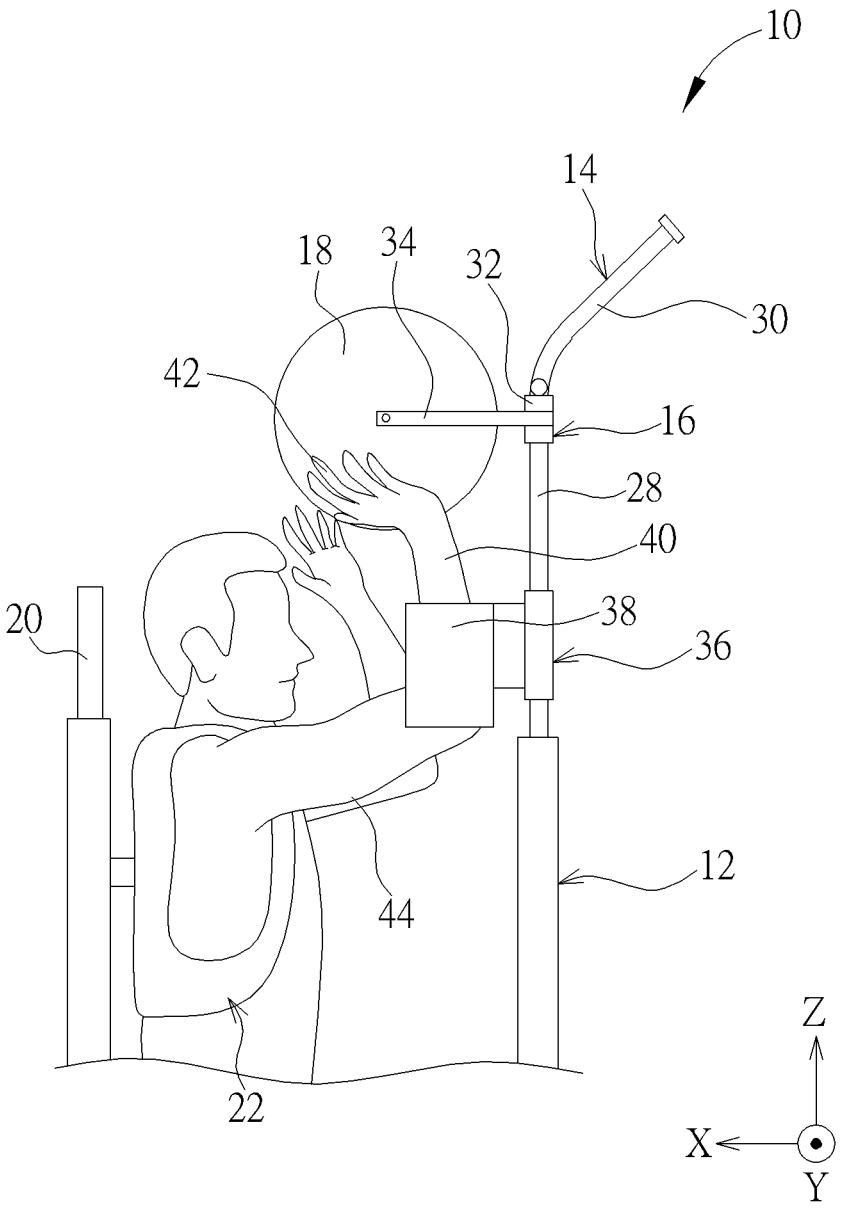
FIG. 3 is a side view of the torso attachment member in FIG. 2 guiding the user's torso to move vertically to a first initial position along a second vertical rail structure.
Figure 4:
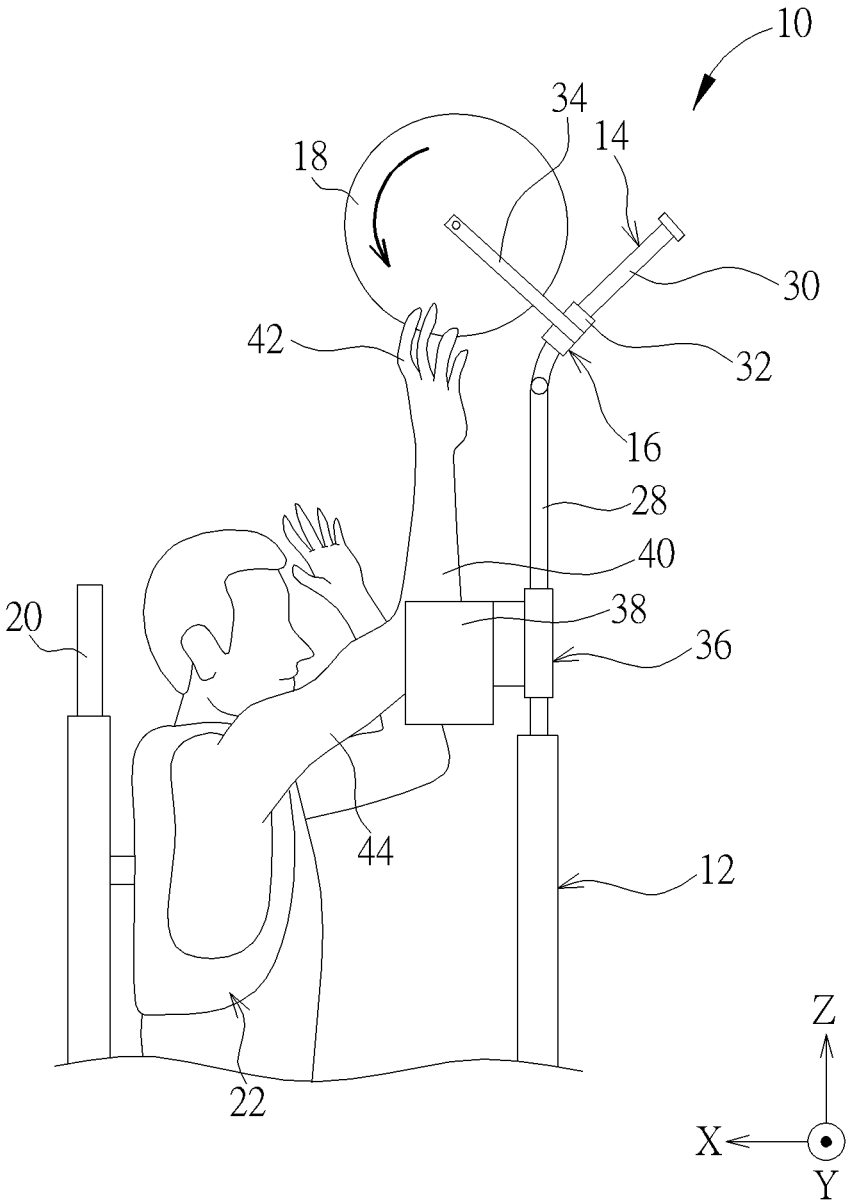
FIG. 4 is a side view of a first base portion in FIG. 3 sliding to a shooting position on an oblique rail portion.

More detailed description for operating the basketball shooting training device 10 is provided as follows. Please refer to FIG. 2, FIG. 3, and FIG. 4. FIG. 2 is a side view of a user wearing the torso attachment member 22 and propping the first basketball imitation member 18 at a knee bending position. FIG. 3 is a side view of the torso attachment member 22 in FIG. 2 guiding the user's torso to move vertically to a first initial position along the second vertical rail structure 20. FIG. 4 is a side view of the first base portion 32 in FIG. 3 sliding to a shooting position on the oblique rail portion 30. After the user wears the torso attachment member 22, the user could put his lower arm 40 between the two guide sheets 38, prop the first basketball imitation member 18 by his shooting hand 42, and then adjust positions of the two guide sheets 38 relative to the user by properly moving the first vertical rail structure 14 leftward and rightward and pivoting the first vertical rail structure 14 forward and rearward for aligning the user's lower arm 40 with the user's upper arm 44 at the same vertical plane (i.e. an XZ plane shown in FIG. 2). After that, the user could bend his knee to perform a ready action at the knee bending position as shown in FIG. 2 for basketball shooting. Subsequently, the torso attachment member 22 could guide the user's torso to move vertically from the knee bending position as shown in FIG. 2 to the first initial position as shown in FIG. 3 along the second vertical rail structure 20 during the user stretches his knee, and then the user could propel the first basketball imitation member 18 upwardly by his shooting hand 42 to make the first base portion 32 slides from the first initial position as shown in FIG. 3 on the vertical rail portion 28 to the shooting position as shown in FIG. 4 on the oblique rail portion 30.

To be noted, in this embodiment, the first basketball imitation member 18 could be rotatably connected to the first arm portion 34 (e.g. by connecting the first basketball imitation member 18 to the first arm portion 34 via a torsional spring) for allowing the user's fingers to rotate the first basketball imitation member 18 counterclockwise at a specific angle (e.g. 30% but not limited thereto) when the first base portion 32 slides to the shooting position as shown in FIG. 4 on the oblique rail portion 30, so as to make the user's fingers complete a follow-through motion.

In such a manner, the basketball shooting training device 10 could guide the user's shooting hand 42 to complete a set shot along the first vertical rail structure 14 in the case of his lower arm 40 positioned at the same vertical plane with his upper arm 44, so that the basketball shooting training device 10 could train the user to develop both proper wrist motion and proper arm motion for shooting a basketball into a basket successfully as well as achieve the motion restriction purpose as the user repeatedly performs the aforesaid basketball shooting training process.

Moreover, since the first base portion 32 could slide from the shooting position on the oblique rail portion 30 back to the first initial position on the vertical rail portion 28 due to the weight of the first basketball imitation member 18 while the first basketball imitation member is not propped by the user's shooting hand 42, the present invention could further adopt a braking design for stopping the first base portion 32 at the first initial position, so as to efficiently prevent the first basketball imitation member 18 from dropping fast to accidentally cause damage to the user. That is, the basketball shooting training device 10 could further include a braking device 46 disposed on the first sliding base 16 for braking the first sliding base 16 during the first base portion 32 slides from the shooting position on the oblique rail portion 30 back to the first initial position on the vertical rail portion 28.

Figure 5:
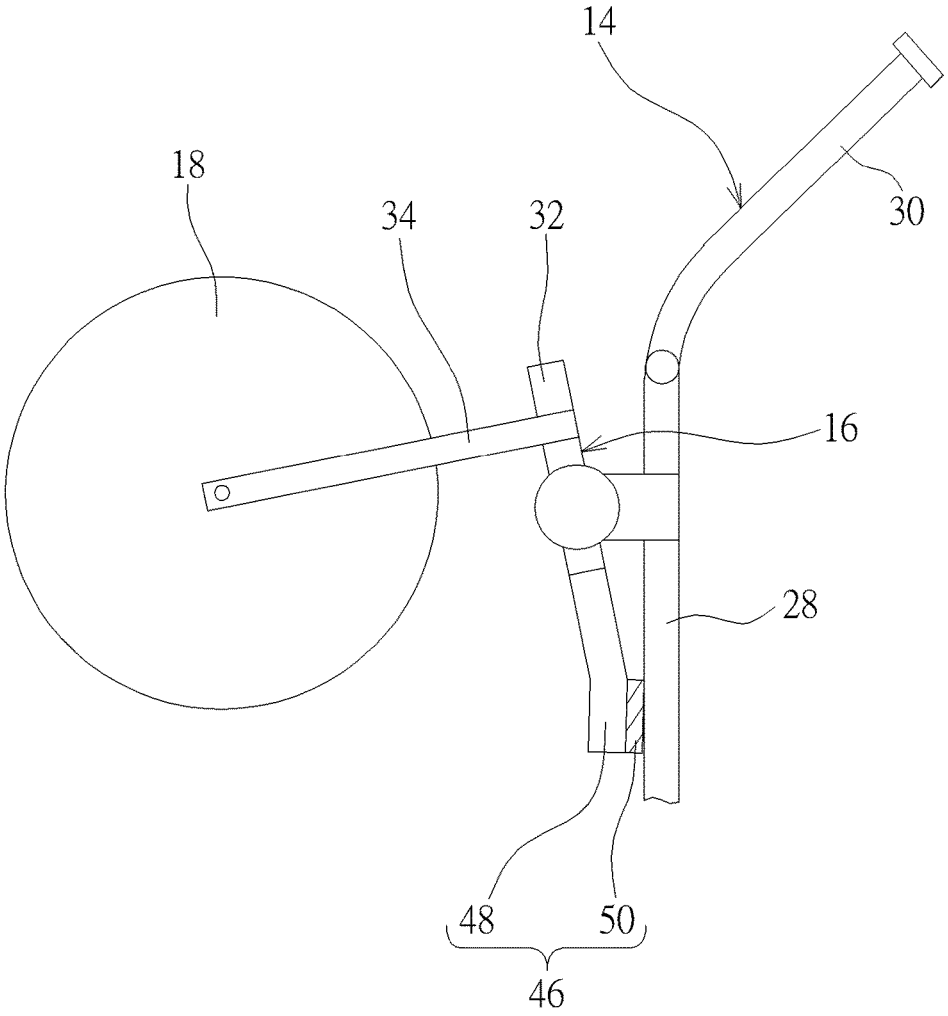
FIG. 5 is a side view of a braking device being disposed on a first sliding base according to another embodiment of the prevent invention.
Figure 6:
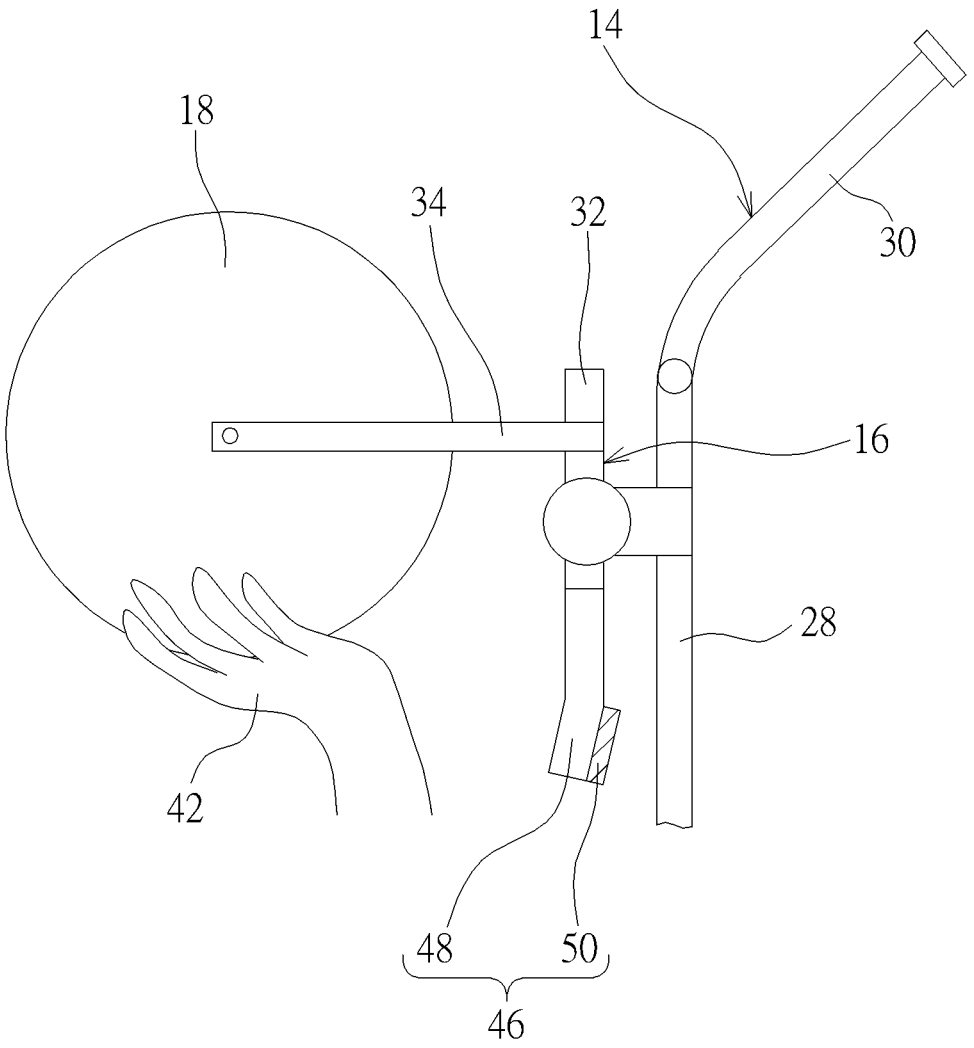
FIG. 6 is a side view of the first sliding base pivoting relative to a first vertical rail structure to make the braking device separate from the first vertical rail structure.

For example, please refer to FIG. 5 and FIG. 6. FIG. 5 is a side view of the braking device 46 being disposed on the first sliding base 16 according to another embodiment of the prevent invention. FIG. 6 is a side view of the first sliding base 16 pivoting relative to the first vertical rail structure 14 to make the braking device 46 separate from the first vertical rail structure 14. Components both mentioned in this embodiment and the aforesaid embodiment represent components with similar structures or functions, and the related description is omitted herein.

As shown in FIG. 5 and FIG. 6, in this embodiment, the first sliding base 16 could be pivoted to the first vertical rail structure 14, and the braking device 46 could include a bending arm 48 and a braking pad 50. The bending arm 48 extends from the first base portion 32. The braking pad 50 is disposed at a bottom end of the bending arm 48. Accordingly, as shown in FIG. 5, the first sliding base 16 could pivot relative to the first vertical rail structure 14 cooperatively with the bending arm 48 due to the weight of the first basketball imitation member to make the braking pad 50 contact with the first vertical rail structure 14 for stopping the first sliding base 16 at the first initial position when the first basketball imitation member 18 is not propped. On the other hand, as shown in FIG. 6, when the first basketball imitation member 18 is propelled upwardly by the user's shooting hand 42, the first sliding base 16 could pivot relative to the first vertical rail structure 14 cooperatively with the bending arm 48 to make the braking pad 50 separate from the first vertical rail structure 14, so that the user could continue propelling the first basketball imitation member 18 upwardly. Via the aforesaid braking design, the operational safety of the basketball shooting training device 10 could be greatly improved.

Figure 7:
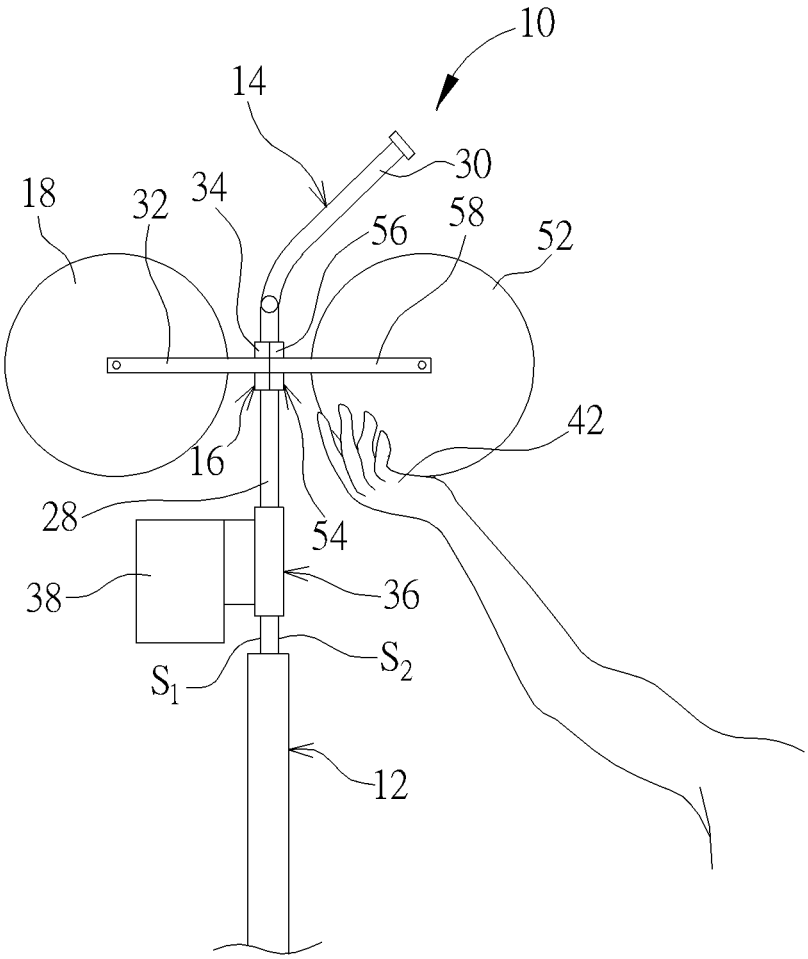
FIG. 7 is a side view of the user's shooting hand propping a second basketball imitation member according to another embodiment of the present invention.
Figure 8:
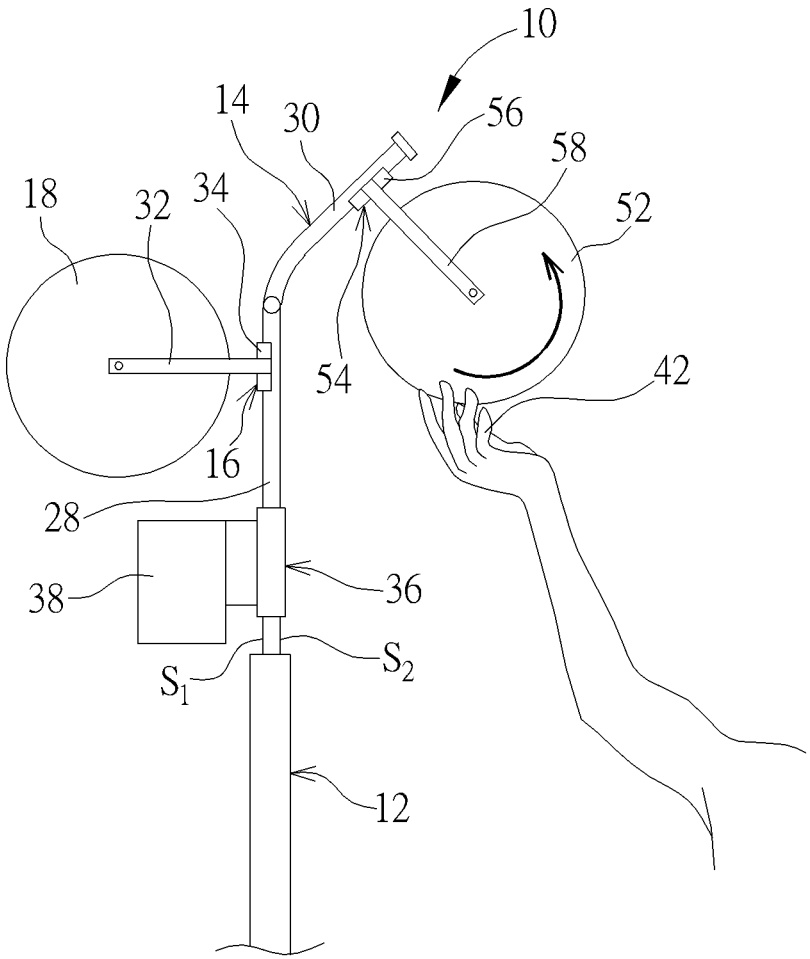
FIG. 8 is a side view of the user's shooting hand propelling the second basketball imitation member in FIG. 7 upwardly to complete a hook shot.

It should be mentioned that the basketball shooting training device 10 could further have a hook shot training function. Please refer to FIG. 7 and FIG. 8. FIG. 7 is a side view of the user's shooting hand 42 propping a second basketball imitation member 52 according to another embodiment of the present invention. FIG. 8 is a side view of the user's shooting hand 42 propelling the second basketball imitation member 52 in FIG. 7 upwardly to complete a hook shot. Components both mentioned in this embodiment and the aforesaid embodiment represent components with similar structures or functions, and the related description is omitted herein.

As shown in FIG. 7 and FIG. 8, in this embodiment, the basketball shooting training device 10 could further include the second basketball imitation member 52 and a second sliding base 54. The second sliding base 54 has a second base portion 56 and a second arm portion 58. The second base portion 56 is slidably disposed on a second side $S_2$ of the first vertical rail structure 14 opposite to the first base portion 32 for sliding along the first vertical rail structure 14. The second arm portion 58 extends from the second base portion 56. The second basketball imitation member 52 could be connected to the second arm portion 58 so that the user could prop the second basketball imitation member 52 with his shooting hand for performing a hooking motion. In practical application, the weight of the second basketball imitation member 52 could be increased by adding fillers (e.g. water or sand) into the second basketball imitation member 52 for achieving the muscles training purpose.

Furthermore, in this embodiment, the second basketball imitation member 52 could be rotatably connected to the second arm portion 34 (e.g. by connecting the second basketball imitation member 52 to the second arm portion 34 via a torsional spring) for allowing the user's fingers to rotate the second basketball imitation member 52 at a specific angle (e.g. 30°, but not limited thereto) when the second base portion 32 slides to a hooking position as shown in FIG. 8 on the oblique rail portion 30, so as to make the user's fingers complete a follow-through motion.

To be noted, the aforesaid arm positioning design could also be applied to this embodiment for positioning the user's lower arm at the same vertical plane with the user's upper arm while propping and then propelling the second basketball imitation member 52 upwardly by the user's shooting hand. The related description could be reasoned by analogy according to the aforesaid embodiment and be omitted herein.

In such a manner, the user could prop and then propel the second basketball imitation member 52 upwardly by his shooting hand 42 to make the second base portion 58 slide from a second initial position as shown in FIG. 7 on the vertical rail portion 28 to the hooking position as shown in FIG. 8 on the oblique rail portion 30, so as to complete a hook shot along the first vertical rail structure 14. Accordingly, the basketball shooting training device 10 could train the user to develop both proper wrist motion and proper arm motion for hooking a basketball into a basket successfully as well as achieve the motion restriction purpose as the user repeatedly performs the aforesaid basketball hooking training process.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A basketball shooting training device comprising:

a main frame having a transverse frame portion and a standing frame portion for standing on a holding plane, the transverse frame portion is connected to the standing frame portion;

a first vertical rail structure disposed on the transverse frame portion, the first vertical rail structure having a vertical rail and an oblique rail, the oblique rail having an arc-shaped rail section and an oblique rail section, the arc-shaped rail section being connected to a top end of the vertical rail;

a first sliding base having a first base member and a first arm member, the first base member jacketing the first vertical rail structure and slidably contacting a first side of the first vertical rail structure for sliding along the first vertical rail structure, the first arm member extending from an outer edge of the first base member; and a first basketball imitation member connected to the first arm member, the first side of the first vertical rail structure facing the first basketball imitation member;

wherein when the first basketball imitation member is propped and then propelled upwardly by a user's hand, the first base member slides from a first initial position on the vertical rail portion to a shooting position on the oblique rail and keeps contacting the vertical rail without pivoting relative to the vertical rail to make the first basketball imitation member move straightly and upwardly along the vertical rail, move along the arc-shaped rail section, and then move straightly and obliquely along the oblique rail section when the first base member slides along the first vertical rail structure for guiding the user's hand to complete a set shot along the first vertical rail structure.

2. The basketball shooting training device of claim 1, wherein an arm guide base is disposed on the first side of the first vertical rail structure and located under the first sliding base, and the arm guide base has two guide sheets spaced apart thereon for constraining the user's lower arm put therebetween at the same vertical plane with the user's upper arm.

3. The basketball shooting training device of claim 2, wherein the two guide sheets are movably disposed on the arm guide base and the first vertical rail structure is movable leftward and rightward and pivotable forward and rearward relative to the transverse frame portion for adjusting positions of the two guide sheets relative to the user so as to align the user's lower arm with the user's upper arm at the same vertical plane.

4. The basketball shooting training device of claim 1, wherein the first basketball imitation member is rotatably connected to the first arm member for allowing the user's fingers to rotate the first basketball imitation member at a specific angle when the first base member slides to the shooting position on the oblique rail, so as to make the user's fingers complete a follow-through motion.

5. The basketball shooting training device of claim 1 further comprising:

a second vertical rail structure spaced apart from the main frame and connected to the standing frame portion; and a torso attachment member slidably disposed on the second vertical rail structure for attaching to the user's torso so as to guide the user's torso to move vertically from a knee bending position to the first initial position along the second vertical rail structure during a period that the first basketball imitation member is propelled from the knee bending position to the first initial position upwardly.

6. The basketball shooting training device of claim 1 further comprising:

a second sliding base having a second base portion and a second arm portion, the second base portion being slidably disposed on a second side of the first vertical rail structure opposite to the first base member for sliding along the second vertical rail structure, the second arm portion extending from the second base portion; and a second basketball imitation member connected to the second arm portion;

wherein when the second basketball imitation member is propped and then propelled upwardly by the user's hand, the second base portion slides from a second initial position on the vertical rail to a hooking position on the oblique rail for guiding the user's hand to complete a hook shot along the first vertical rail structure.

7. The basketball shooting training device of claim 6, wherein the second basketball imitation member is rotatably connected to the second arm portion for allowing the user's fingers to rotate the second basketball imitation member at a specific angle when the second base portion slides to the hooking position on the oblique rail, so as to make the user's fingers complete a follow-through motion.

8. The basketball shooting training device of claim 1 further comprising:

a braking device disposed on the first sliding base for braking the first sliding base during the first base member slides from the shooting position on the oblique rail back to the first initial position on the vertical rail due to the weight of the first basketball imitation member.

9. The basketball shooting training device of claim 8, wherein the first sliding base is pivoted to the first vertical rail structure, the braking device comprises a bending arm and a braking pad, the bending arm extends from the first base member, the braking pad is disposed at a bottom end of the bending arm, the first sliding base pivots relative to the first vertical rail structure cooperatively with the bending arm due to the weight of the first basketball imitation member to make the braking pad contact with the first vertical rail structure for stopping the first sliding base at the first initial position when the first basketball imitation member is not propped, and the first sliding base pivots relative to the first vertical rail structure cooperatively with the bending arm to make the braking pad separate from the first vertical rail structure when the first basketball imitation member is propelled upwardly by the user's hand.

10. The basketball shooting training device of claim 1, wherein the oblique rail is pivoted to the top end of the vertical rail for adjusting an oblique angle of the oblique rail relative to the vertical rail.

11. A basketball shooting training device comprising:

a main frame having a transverse frame portion and a standing frame portion for standing on a holding plane, the transverse frame portion being connected to the standing frame portion;

a first vertical rail structure disposed on the transverse frame portion, the first vertical rail structure having a vertical rail and an oblique rail connected to a top end of the vertical rail;

a first sliding base having a first base member and a first arm member, the first base member being slidably pivoted to a first side of the first vertical rail structure for sliding along the first vertical rail structure, the first arm member extending from the first base member;

a first basketball imitation member connected to the first arm member; and a braking device disposed on the first sliding base for braking the first sliding base during the first base member slides from a shooting position on the oblique rail back to a first initial position on the vertical rail due to weight of the first basketball imitation member, the braking device comprising a bending arm and a braking pad, the bending arm extending from the first base member, the braking pad being disposed at a bottom end of the bending arm, the first sliding base pivoting relative to the first vertical rail structure cooperatively with the bending arm due to the weight of the first basketball imitation member to make the braking pad contact with the first vertical rail structure for stopping the first sliding base at the first initial position when the first basketball imitation member is not propped, and the first sliding base pivoting relative to the first vertical rail structure cooperatively with the bending arm to make the braking pad separate from the first vertical rail structure when the first basketball imitation member is propelled upwardly by a user's hand;

wherein when the first basketball imitation member is propped and then propelled upwardly by the user's hand, the first base member slides from the first initial position on the vertical rail to the shooting position on the oblique rail for guiding the user's hand to complete a set shot along the first vertical rail structure.

12. The basketball shooting training device of claim 11, wherein an arm guide base is disposed on the first side of the first vertical rail structure and located under the first sliding base, and the arm guide base has two guide sheets spaced apart thereon for constraining the user's lower arm put therebetween at the same vertical plane with the user's upper arm.

13. The basketball shooting training device of claim 12, wherein the two guide sheets are movably disposed on the arm guide base and the first vertical rail structure is movable leftward and rightward and pivotable forward and rearward relative to the transverse frame portion for adjusting positions of the two guide sheets relative to the user so as to align the user's lower arm with the user's upper arm at the same vertical plane.

14. The basketball shooting training device of claim 11, wherein the first basketball imitation member is rotatably connected to the first arm member for allowing the user's fingers to rotate the first basketball imitation member at a specific angle when the first base member slides to the shooting position on the oblique rail, so as to make the user's fingers complete a follow-through motion.

15. The basketball shooting training device of claim 11 further comprising:

a second vertical rail structure spaced apart from the main frame and connected to the standing frame portion; and a torso attachment member slidably disposed on the second vertical rail structure for attaching to the user's torso so as to guide the user's torso to move vertically from a knee bending position to the first initial position along the second vertical rail structure during a period that the first basketball imitation member is propelled from the knee bending position to the first initial position upwardly.

16. The basketball shooting training device of claim 11, wherein the oblique rail is pivoted to the top end of the vertical rail for adjusting an oblique angle of the oblique rail relative to the vertical rail.

* * * * *